US012606277B2

(12) United States Patent
Agerup et al.

(10) Patent No.: US 12,606,277 B2
(45) Date of Patent: Apr. 21, 2026

(54) HANG-OFF SYSTEM AND METHOD FOR USE OF HANG-OFF SYSTEM

(71) Applicant: Econnect Energy AS, Oslo (NO)

(72) Inventors: Jørgen Fredrik Agerup, Oslo (NO); David Mikal Knutsen, Vettre (NO)

(73) Assignee: Econnect Energy AS, Oslo (NO)

( * ) Notice: Subject to any disclaimer, the term of this patent is extended or adjusted under 35 U.S.C. 154(b) by 0 days.

(21) Appl. No.: 18/861,434

(22) PCT Filed: May 5, 2023

(86) PCT No.: PCT/EP2023/062053

§ 371 (c)(1),
(2) Date: Oct. 29, 2024

(87) PCT Pub. No.: WO2023/214073

PCT Pub. Date: Nov. 9, 2023

(65) Prior Publication Data

US 2025/0282450 A1 Sep. 11, 2025

(30) Foreign Application Priority Data

May 5, 2022 (NO) ..... 20220518

(51) Int. Cl.
*B63B 27/24* (2006.01)
*B63B 27/34* (2006.01)

(52) U.S. Cl.
CPC ..... *B63B 27/24* (2013.01); *B63B 27/34* (2013.01)

(58) Field of Classification Search
CPC ..... F16L 1/207; B63B 27/24; B63B 27/34
(Continued)

(56) References Cited

U.S. PATENT DOCUMENTS 8,641,323 B2 2/2014 Tame
8,894,326 B2 * 11/2014 Randrianarivony ..... F16L 1/19 405/168.1

(Continued)

FOREIGN PATENT DOCUMENTS

KR 101 915 224 B1 11/2018
NO 20200460 A1 10/2021

(Continued)

OTHER PUBLICATIONS

International Search Report issued in corresponding International Application No. PCT/EP2023/062053, mailed on Aug. 30, 2023 (6 pages).

(Continued)

*Primary Examiner* — Timothy L Maust
(74) *Attorney, Agent, or Firm* — Osha Bergman Watanabe & Burton LLP

(57) ABSTRACT

A hang-off system is for hang-off of an end section of a first end of a transfer pipe to a floating structure or vessel. The end section of the transfer pipe is provided with a pipe hang-off flange. The hang-off system includes a gas balcony structure configured for being fastened to an outside of a shipside of the floating structure or vessel. The gas balcony structure includes a hang-off collar configured to secure the transfer pipe to the gas balcony structure. The hang-off collar includes at least two collar flanges. The at least two collar flanges define a central opening of the hang-off collar for passing through the end section of the first end of the transfer pipe. At least one of the collar flanges is movably arranged on the hang-off collar. A linear actuator moves the at least one movable collar flange between a first position and a second position. When in the first position, the central opening is larger than a transverse cross-sectional area of the pipe hang-off flange. When in the second position, the central opening is smaller than a transverse cross-sectional (Continued)

area of the pipe hang-off flange. A clamping mechanism is configured to clamp the pipe hang-off flange to the collar flanges.

10 Claims, 8 Drawing Sheets

(58) Field of Classification Search
USPC ..... 405/184.4; 166/348
See application file for complete search history.

(56) References Cited

U.S. PATENT DOCUMENTS 9,109,404 B2 * 8/2015 Gilmore ..... E21B 17/01
9,222,317 B2 * 12/2015 Yemington ..... B66C 13/02
9,732,565 B2 * 8/2017 Roodenburg ..... E21B 7/128
10,443,764 B2 * 10/2019 Green ..... F16L 1/19
2016/0097468 A1 4/2016 Hufthammer
2018/0087328 A1 3/2018 De Barros et al.

FOREIGN PATENT DOCUMENTS

WO 2015/048263 A1 4/2015
WO 2019/117712 A9 8/2020

OTHER PUBLICATIONS

Written Opinion issued in corresponding International Application No. PCT/EP2023/062053, mailed on Aug. 30, 2023 (7 pages).
Search Report issued in counterpart Norwegian Patent Application No. 20220518 mailed on Nov. 24, 2022 (2 pages).

* cited by examiner

P1:

P2:

HANG-OFF SYSTEM AND METHOD FOR USE OF HANG-OFF SYSTEM

TECHNICAL FIELD

The present invention relates to a hang-off system for hanging-off of a transfer pipe from a floating structure or vessel. The invention also relates to the method of pulling-in of the transfer pipe using the hang-off system.

BACKGROUND

Natural gas is used to reduce emissions locally compared to other hydrocarbon fuels. There is an increasing demand for gas worldwide. Furthermore, trade patterns are changing with new production fields emerging as well new markets access, as for example in Europe.

All these global demands require efficient transport and transfer of natural gas in the form of liquefied natural gas (LNG).

Today's loading and unloading of LNG is done via jetties, quays or other fixed infrastructure, requiring large infrastructure investments and long lead times to realize new LNG terminals.

One object of the present invention is to provide an improved hang-off system. The improved hang-off system is an enabler for floating or submerged transfer systems and thus reduced investment cost.

The present invention is suitable for LNG but can also be used for a variety of other fluids.

SUMMARY OF THE INVENTION

The present invention relates to a hang-off system for hang-off of an end section of a first end of a transfer pipe to a floating structure or vessel, the end section of the transfer pipe being provided with a pipe hang-off flange, wherein the hang-off system comprises:

- a gas balcony structure configured for being fastened to an outside of a shipside of the floating structure or vessel, the gas balcony structure comprising a hang-off collar configured to secure the transfer pipe to the gas balcony structure, wherein the hang-off collar comprises:

- at least two collar flanges, the at least two collar flanges defining a central opening of the hang-off collar for passing through the end section of the first end of the transfer pipe, and wherein at least one of the collar flanges is movably arranged on the hang-off collar,
- a linear actuator for moving the at least one movable collar flange between a first position and a second position, wherein when in the first position, the central opening is larger than a transverse cross-sectional area of the pipe hang-off flange, and wherein when in the second position, the central opening is smaller than a transverse cross-sectional area of the pipe hang-off flange,
- a clamping mechanism configured to clamp the pipe hang-off flange to the collar flanges.

In one aspect, the end section of the first end of the transfer pipe comprises a coupling for connecting to an end of a hose provided on the floating structure or vessel.

In one aspect, the hang-off collar further comprises a locking mechanism for locking the collar flanges in the second position.

In one aspect, the linear actuator is one from the group consisting of: a hydraulic, a pneumatic, and an electrical actuator.

In one aspect, the gas balcony structure comprises a winch system for pull-in and/or release of the transfer pipe through the central opening.

In one aspect, the collar flanges are arranged with an inclination towards the shipside relative to a horizonal plane of the floating structure or vessel, the inclination being adapted to a catenary profile of the transfer pipe.

In one aspect, the collar flanges are provided with pipe grips adapted to the circumference of the transfer pipe end termination for gripping around the transfer pipe when the collar flanges are in the second position and for supporting transversal or bending loads of the transfer pipe.

In one aspect, the hang-off collar comprises two or four movable collar flanges.

The present invention relates further to a method for pull-in of a first end of a transfer pipe using the hang-off system above, comprising:

- having the collar flanges in the first position,
- fastening a winch wire of the winch system to the end section of the transfer pipe,
- hoisting the end section through the opening of the hang-off collar until the pipe hang-off flange is above the collar flanges,
- when the hang-off flange is above the collar flanges, moving the collar flanges to the second position using the linear actuator and maintaining the second position, then
- paying out the winch wire to lower the transfer pipe until the pipe-hang-off flange reaches the collar flanges, then
- clamping the pipe hang-off flange to the collar flanges using the clamping mechanism.

In one aspect, the method further comprises locking the collar flanges in the second position using the above locking mechanism and releasing the linear actuator.

The above hang-off device enables tie-in of a flexible pipe end termination to a ship side near the midship manifold of a vessel in a safe and efficient manner. One advantage over prior art is that it can be installed on many different types of vessels with minimal impact on the hull structure. In addition, the hang-off device enables pull-in, securing, and release of a flexible pipe end termination in a safe, quick, and cost-efficient manner, with minimal impact on existing ship structure

DETAILED DESCRIPTION

The Hang-Off System

Figure 1:
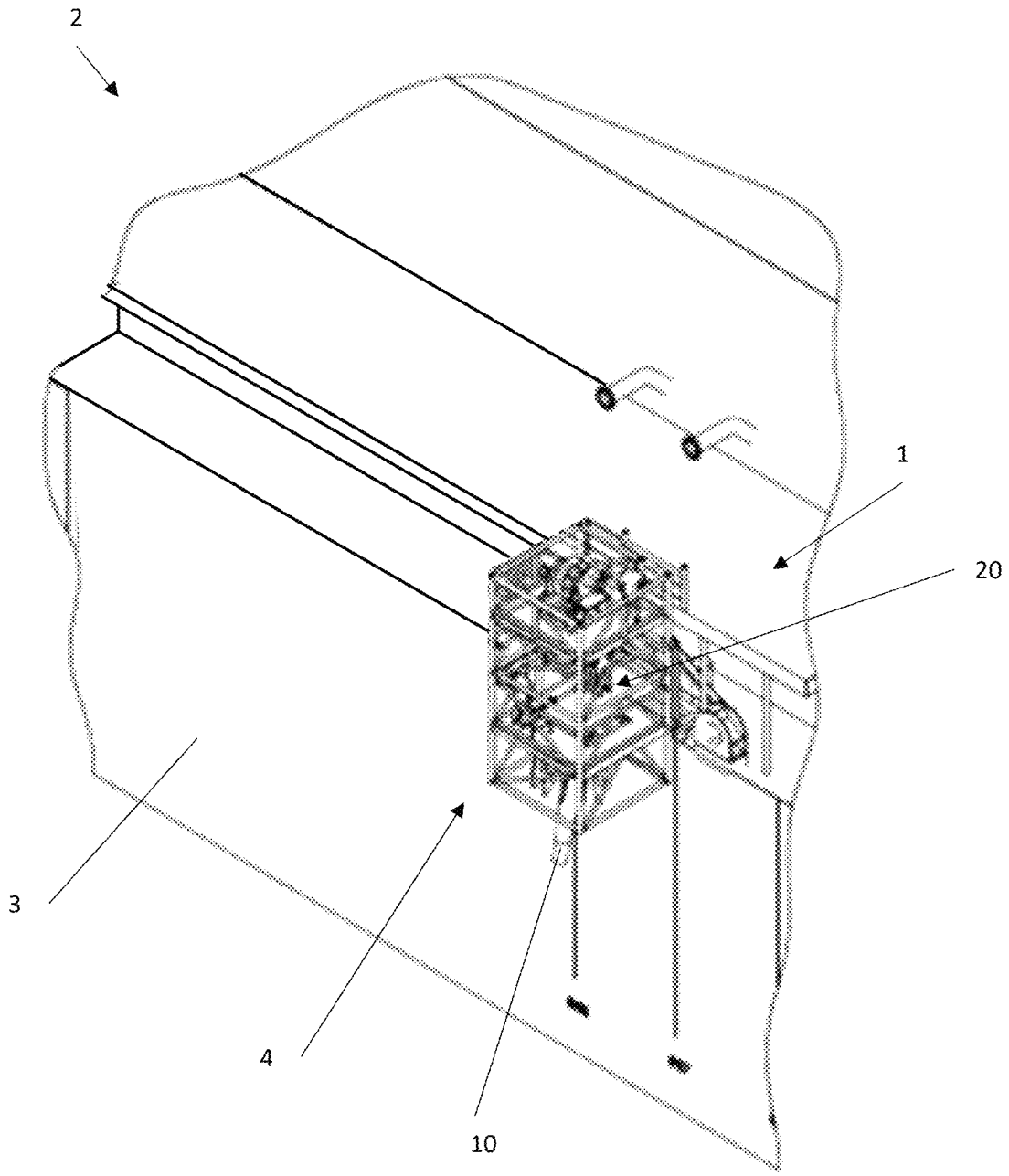
FIG. 1 illustrates schematically the layout of the hang-off system at a ship side.

A transfer system for high pressure gas applications and LNG for semi-permanent deployment, such as in floating storage and regasification unit (FSRU) or floating storage unit (FSU) applications is disclosed.

The system consists of a flexible hose reel which can reel out the hose to an FSU located less than 200 m away of the reel. The structure on the FSU side has removable gas balconies that are located on the outside of the ship side of the FSU and includes equipment for pull-in and release the flexible hose head.

The structure is divided in to three main components:

1) Ship foundation
2) Hang-off Frame
3) Gas Balcony Structure

The ship foundation is integrated into the ship and welded in place.

The hang-off frame is a loose structure that shall be welded to the ship foundation after final alignment of the final positions of the gas balconies in the longitudinal direction of the ship. The function of these is to give the gas balcony some good interface points that is not protruding outside of the ship side in any significant way.

Then the gas balcony structure may be lifted in place using either separate quay or supply ship crane, or by using the manifold crane to lift the gas balcony structure onto the hang-off frame. This can be done inshore or offshore in good weather conditions.

The arrangement has two platform decks, one lower and one upper with access to the winch operations. In addition, there is one foldable platform for use after the flexible pipe end termination is secured to do the tie-in operation between the spool pieces and the flexible pipe end termination.

The hang-off collar structure consists of two longitudinal flanges that are skidded with use of hydraulic cylinders. On top of these collar plates there are fixed clamping tools (for instance camlocks) to ensure that the flexible pipe end termination is fixed to the structure for bending moment.

The end termination can be pulled in by the winch through the open hang-off collar. Once the flexible pipe end termination load flange is pulled up above the hang-off collar plates, the hang-off collar is closed, to secure the end termination in position. Then it is safe for the operator to move closer and lock the camlock bolts, which will fixate the end termination to the hang-off collar. Then the pressure applied by the hydraulic cylinders can be released. When the flexible pipe end termination is safely resting on the collar plate, cam locking bolts are to be secured such that the flexible pipe end termination is resisting bending moments from the flexible pipe.

There are also 4 securing plates to secure the two collar plates in place after pull-in is complete.

The collar plates have low friction Teflon plates mounted below to reduce the friction between the flange and the collar plate during skidding operation.

This remotely operated and actuated hang-off collar arrangement allows the operator to bring the flexible pipe end termination home, lock it in place and secure it, without risk for health and safety due to moving parts.

During pull-in, the flexible pipe end termination will be guided by finger plates. These will be fixed below the collar skid plate foundation and will also have some guide up within the foundation to ensure good alignment of the flexible pipe end termination when pulled through.

A Transfer Pipe

The transfer pipe 10 may be referred to as a hose, a flexible pipe, a metallic pipe, a composite pipe or a thermoplastic composite pipe (TCP) etc. The transfer pipe itself is considered known in the art and will therefore not be described further in detail herein.

Figure 2:
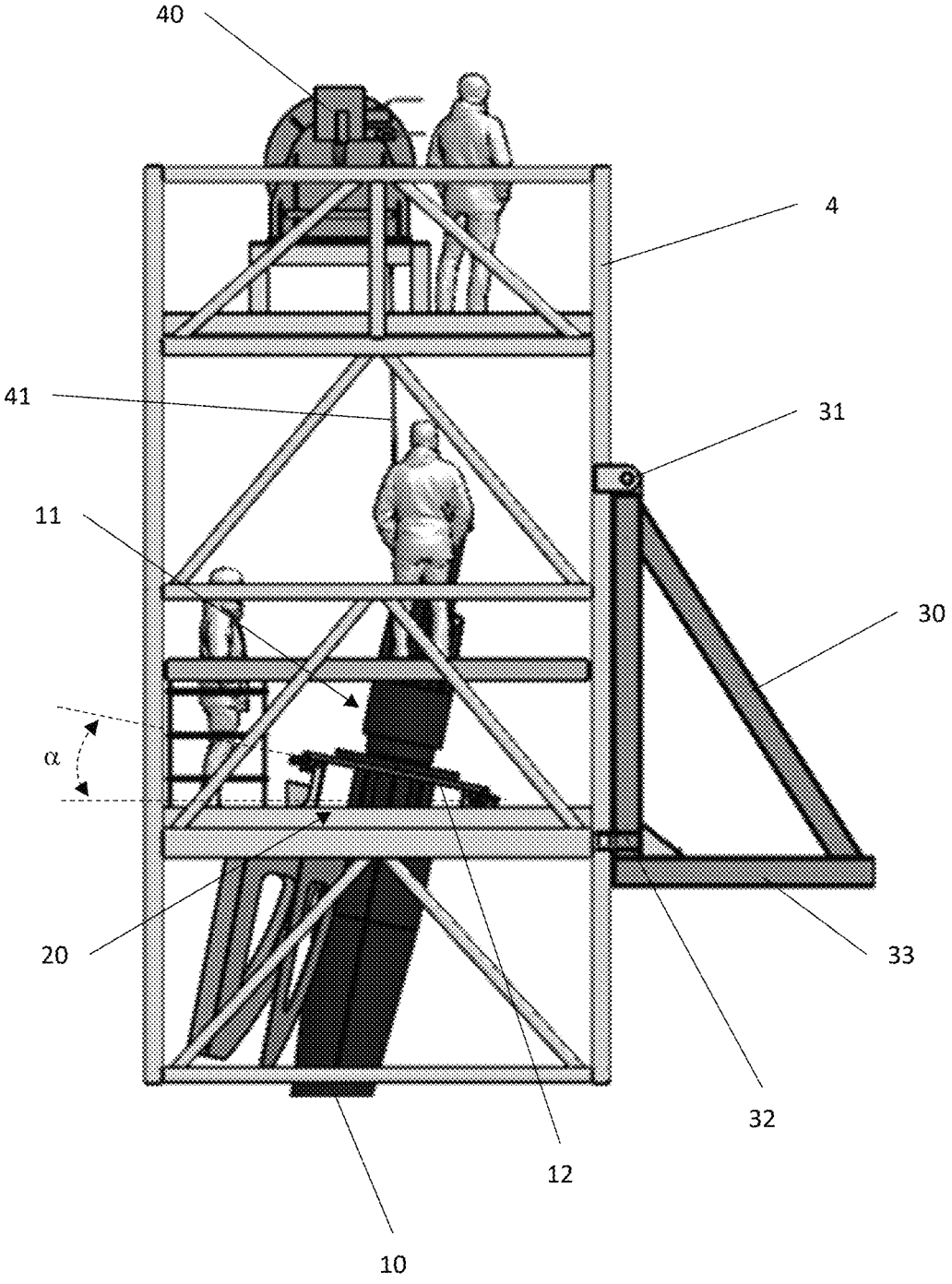
FIG. 2 illustrates a side view of a gas balcony and a wire pull operation.
Figure 3:
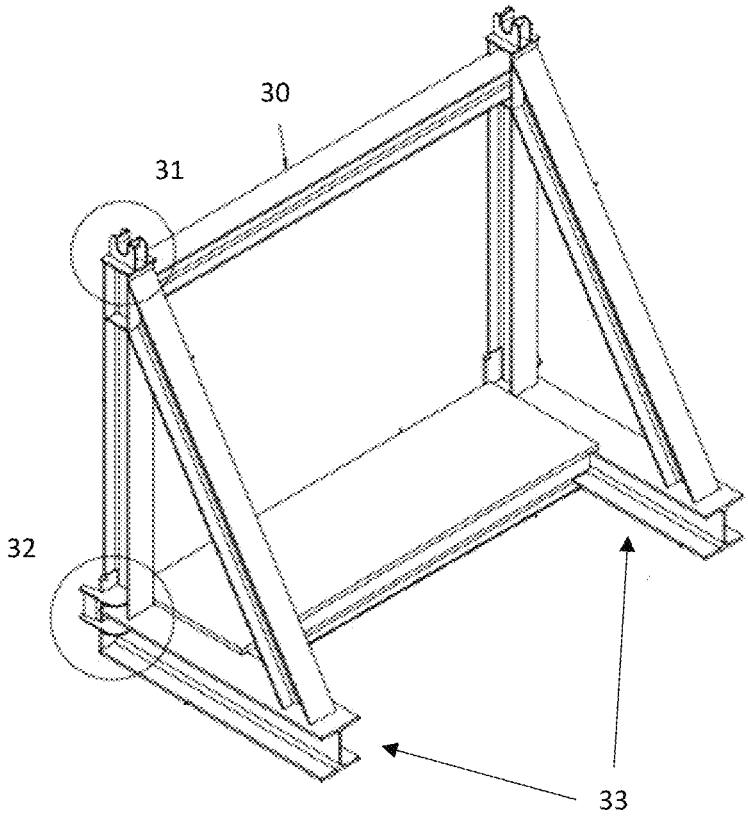
FIG. 3 illustrates a perspective view of a hang-off frame.

As shown in FIG. 2, the transfer pipe has an end section 11 of a first end of the transfer pipe 10. The end section 11 is sometimes referred to as end termination. The end section 11 of the transfer pipe 10 is also equipped with a pipe hang-off flange 12. The purpose of this pipe hang-off flange 12 is to provide a mechanical means of hanging-off the transfer pipe 10 from a ship side 3.

Moreover, the end section 11 of the first end of the transfer pipe 10 could comprise a dry break coupling (not shown) for connecting the transfer pipe 10 to a hose provided on the floating structure or vessel 2 to provide fluid communication from the transfer pipe 10 to the floating structure or vessel 2.

A Gas Balcony Structure and a Hang-Off Frame

The hang-off system 1 comprises also a hang-off system support structure with an outside part and an inside part. The outside part of the hang-off support structure is referred here as a gas balcony structure 4 while the inside part of the hang-off system support structure is referred to as a hang-off frame 30. As shown in FIG. 2, the gas balcony 4 is typically attached to the hang-off frame 30 by an upper connector 31 and a lower connector 32. The upper and lower connectors 31, 32 ensure that the gas balcony structure 4 is aligned and fastened to the outside of the ship side 3. The lower member 33 of the hang-off frame 30 is integrated into the structure of the floating structure or vessel 2 and is typically fastened to a deck by welding, but can also be bolted to a foundation on the floating structure or vessel 2. The structure of the gas balcony structure 4 is a welded steel truss structure.

As shown in FIG. 2, the gas balcony structure 4 contains a hang-off collar 20 for securing the transfer pipe 10 to the gas balcony structure 4. Around the hang-off collar 20, a lower platform is provided. Moreover, the gas balcony structure 4 also contains a winch system 40 on a platform above the hang off collar 20 and the lower platform. As indicated in FIG. 2, personnel may walk on the lower platform and on the upper platform. The winch system 40, and its winch wire 41 are used to pull in or release the transfer pipe 10 relative the balcony during the operation of connecting the transfer pipe 10 to or releasing the transfer pipe 10 from the hang-off collar 20. The transfer pipe 10 enters or leaves the hang-off collar 20 within the gas balcony structure 4, through the central opening 24 of the hang-off collar 20 as shown in FIG. 4.

The Hang-Off Collar

Figure 4:
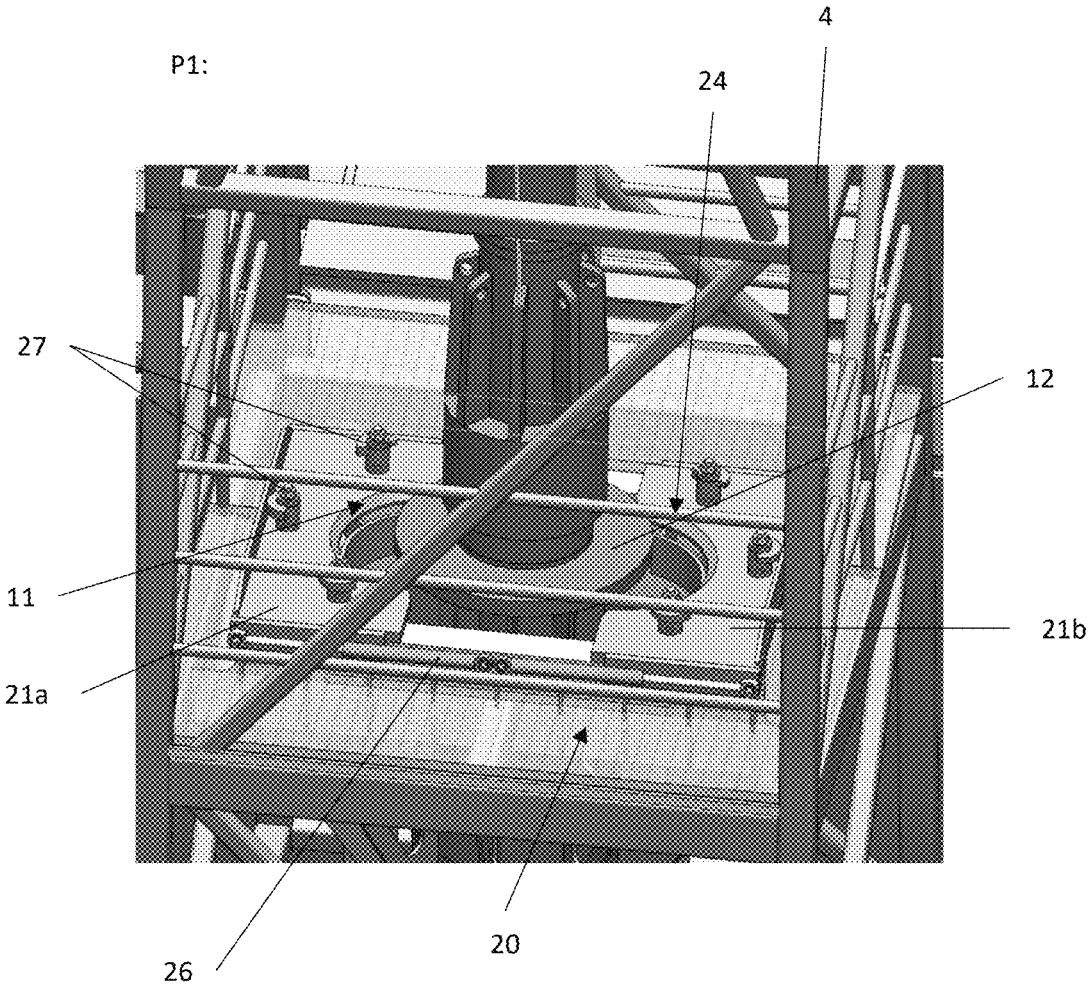
FIG. 4 illustrates a perspective view of a hang-off collar mounted within the gas balcony.

The above hang-off collar 20 installed inside the gas balcony structure 4 as shown in FIG. 4 will now be described in detail. The hang-off collar 20 comprises two collar flanges 21*a*, 21*b*. The at least two collar flanges 21*a*, 21*b* define a central opening 24 of the hang-off collar 20 for passing through the end section 11 of the first end of the transfer pipe 10.

The collar flanges 21*a*, 21*b* of the hang-off collar 20 of the hang-off system 1 are arranged with an inclination towards a shipside 3 of the floating structure or vessel 2 relative to a horizonal plane. The hang-off collar 20 is inclined by an angle $\alpha$ towards the shipside 3 when seen from the balcony, as illustrated in FIG. 2. The inclination is chosen to promote a catenary configuration of the transfer pipe 10.

The two collar flanges 21*a*, 21*b* shown in FIG. 4 can be moved by one or more linear actuators 26 in a plane that is perpendicular to the centerline of the transfer pipe 10. The actuator 26 is either a hydraulic, a pneumatic, or an electrical actuator or gears or wire/winch.

Figure 5:
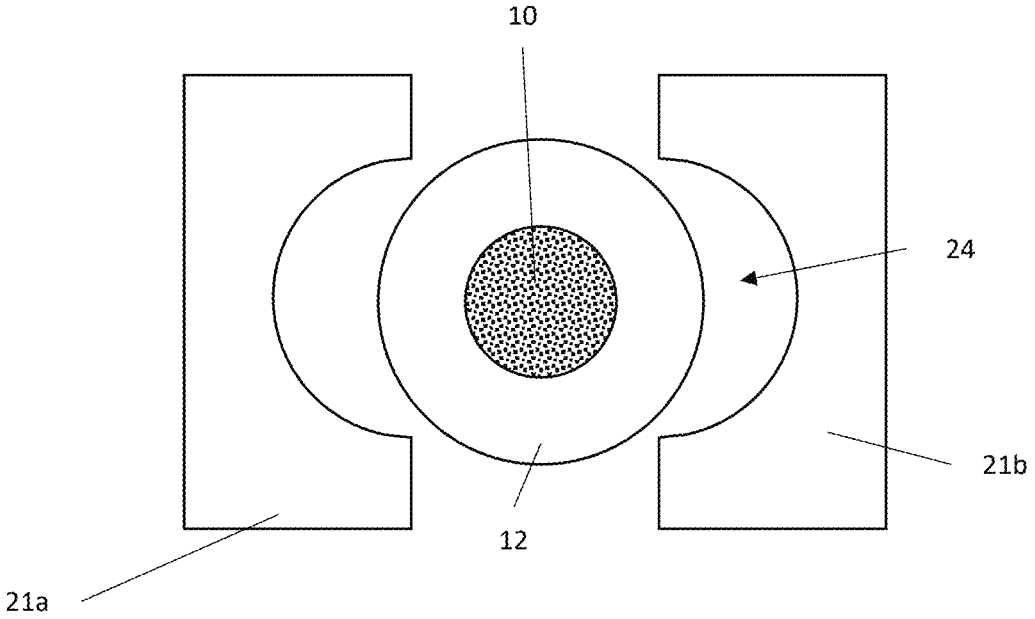
FIG. 5 shows a schematic plan view of a hang-off collar in the first and second position.
Figure 5:
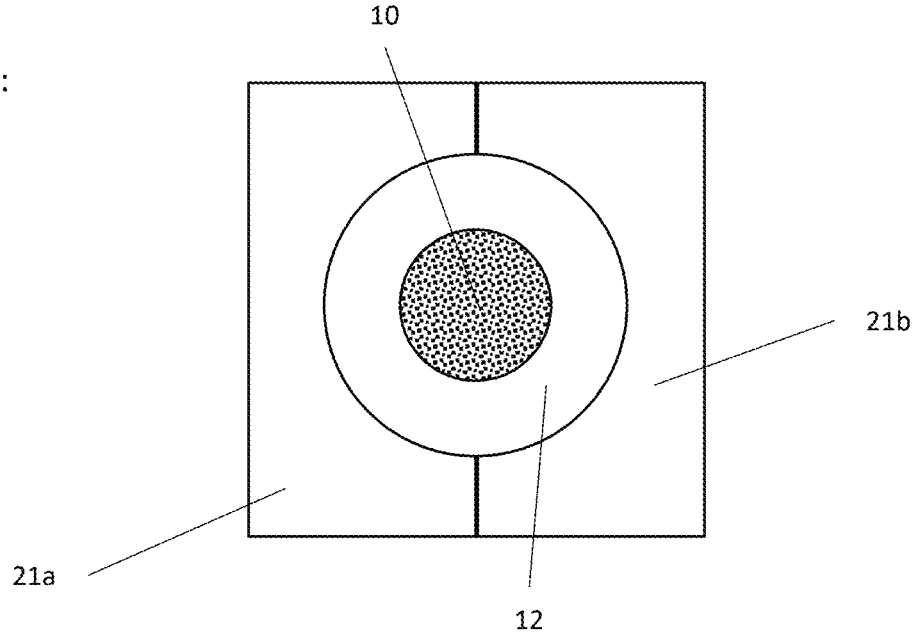

The movable collar flanges 21*a*, 21*b* have two end positions hereby defining a first position P1 and a second position P2, as shown in FIG. 5. The first position P1, shown in FIG. 4 and FIG. 5, is an open position, where the central opening 24 is larger than a transverse cross-sectional area of the pipe hang-off flange 12, hereby allowing passage of the transfer pipe 10 through the central opening 24. The second position P2 is a locking position, where the central opening 24 is smaller than the transverse cross-sectional area of the pipe hang-off flange 12, hereby supporting vertically the transfer pipe 10 and preventing passage of the transfer pipe 10 through the central opening 24.

Figure 6A:
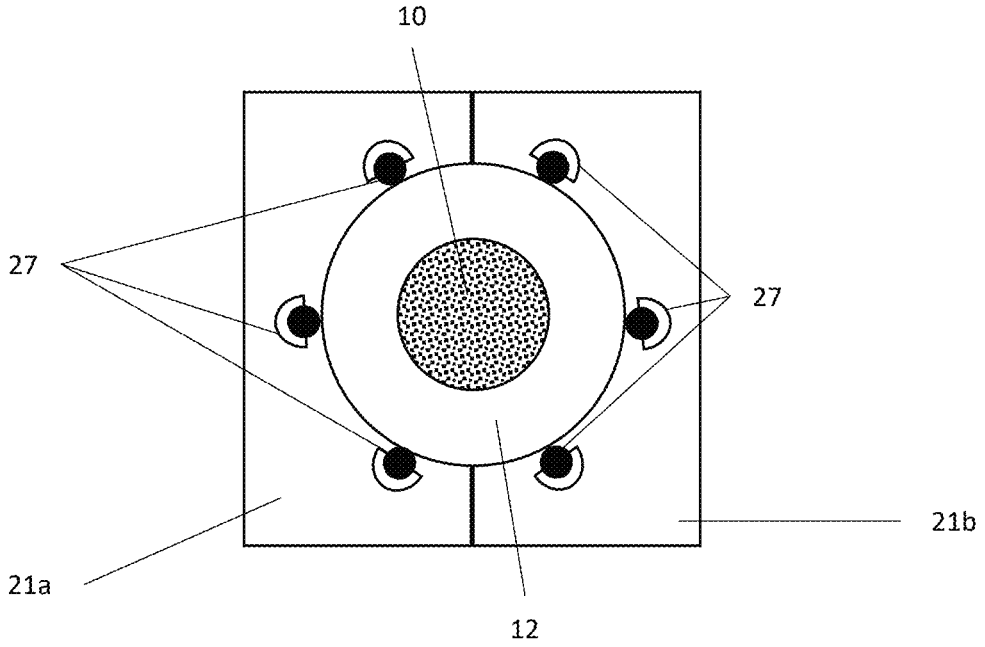
FIG. 6 shows a schematic plan view of a hang-off collar, before (a) and after (b) locking a pipe hang-off flange with a clamping mechanism.
Figure 6B:
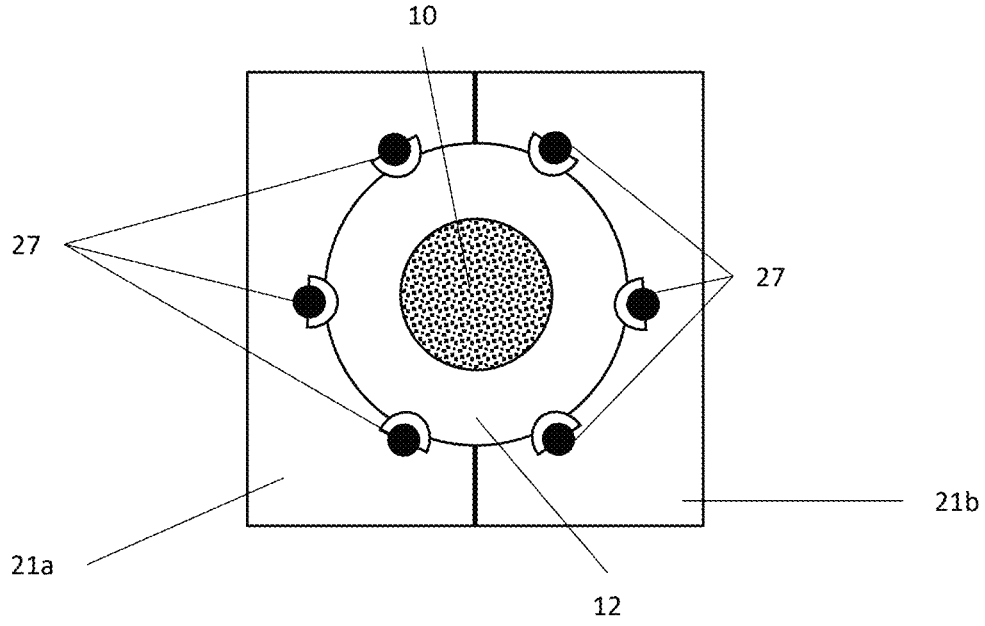

When the collar flanges 21*a*, 21*b* are in the second position P2, the clamping mechanism 27 shown in FIGS. 4 and 6*a*, is tightened to clamp the pipe hang-off flange 12 to the surface of the collar flanges 21*a*, 21*b*, see also FIG. 6*b*. This ensure that the transfer pipe 10 is secured against bending, due for example to the wave movement or sea currents. The clamping mechanism 27 is typically a camlock bolt. These can be bolts through aligned holes in the hang-off collar 20 and gas balcony structure 4 or plates or locking pins or locking pins in the linear actuators 26.

Figure 7:
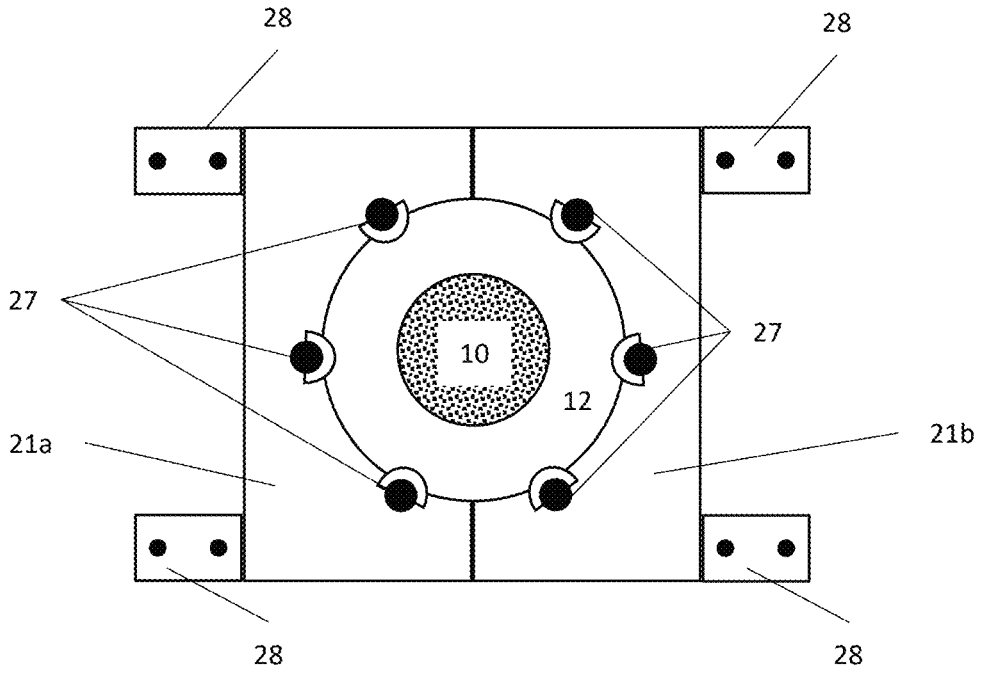
FIG. 7 shows a schematic plan view of a hang-off collar with installed locking mechanism.

Once the transfer pipe 10 is hung-off from the floating structure or vessel 2, a locking mechanism 28, such as the one shown in FIG. 7, is installed on the collar flanges 21*a*, 21*b* to fixate the collar flanges 21*a*, 21*b* in the second position P2. At the same time the actuator 26 can be released so that the actuator 26 is not exerting any force onto the collar flanges 21*a*, 21*b*.

In another embodiment the hang-off collar 20 comprises one or more, as for example four collar flanges.

Figure 8:
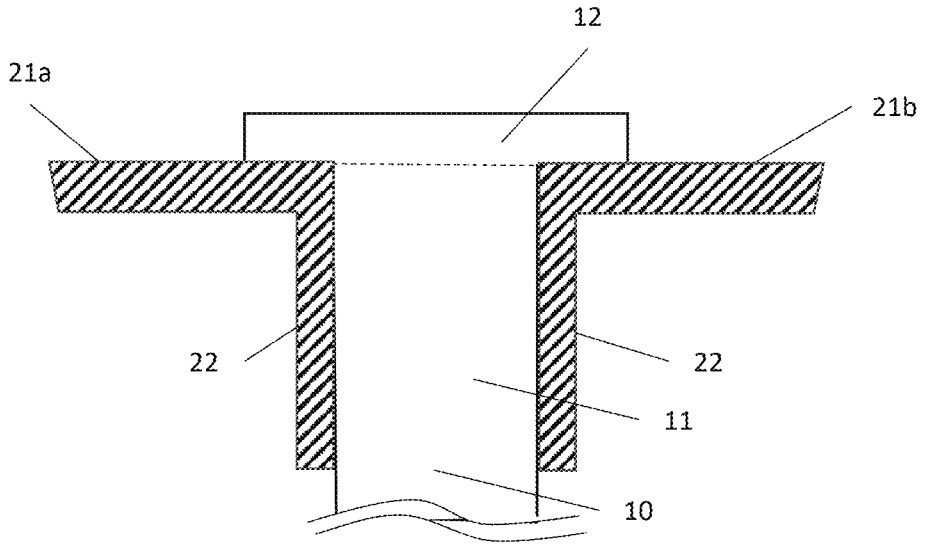
FIG. 8 shows a schematic cross section of a hang-off collar with pipe grips gripping the transfer pipe end section.

In a further embodiment, shown in FIG. 8, the collar flanges 21*a*, 21*b* are provided with pipe grips 22 adapted to the circumference of the transfer pipe end termination 11 for gripping around the transfer pipe 10 when the collar flanges 21*a*, 21*b* are in the second position P2 and for supporting transversal or bending loads of the transfer pipe 10.

Operating the Hang-Off System

With reference to FIGS. 2 and 4-7, the method of pulling in a transfer pipe 10 to a ship side 3 will be described in detail. Initially, the collar flanges 21*a*, 21*b* are moved to the first position P1. The winch wire 41 of the winch system 40 is lowered through the opening 24 and further down to a position below the gas balcony structure 4, where the winch wire 41 is connected to the end section 11 of the first end of the transfer pipe 10. The end section 11 is hoisted through the opening 24 of the hang-off collar 20 by means of the winch system 40 until the pipe hang-off flange 12 is above the collar flanges 21*a*, 21*b*.

Next, the collar flanges 21*a*, 21*b* are moved to the second position P2 using the linear actuator(s) 26. This is followed by lowering the transfer pipe 10 by paying out the winch wire 41 until the pipe hang-off flange 12 touches the surface of the collar flanges 21*a*, 21*b*. The transfer pipe 10 is locked into place by means of the clamping mechanism 27 that acts on the pipe hang-off flange 12.

Subsequently, the additional locking mechanism 28 is installed and the force in the actuator(s) 26 is released. Thus, the collar clamps 21*a*, 21*b* are held in place only by the locking mechanism(s) 28.

After that, fluid communication between the transfer pipe 10 and the floating structure of vessel 2 can be established, by connecting a flexible or rigid pipe segment between the top of the transfer pipe 10 end section, and the vessel manifold, for instance by means of a combination of rigid pipe spools, a hose, and a dry break coupling.

LIST OF REFERENCE NUMBERS

1—hang-off system
2—floating structure or vessel
3—shipside
4—gas balcony structure
10—transfer pipe
11—end section of the first end of the transfer pipe 10
12—pipe hang-off flange
20—hang off collar
21*a*, 21*b*—collar flange
22—pipe grips of the collar flanges (21*a*, 21*b*)
24—central opening
26—linear actuator
27—clamping mechanism
28—locking mechanism
30—hang-off frame
31—upper connector
32—lower connector
33—lower member of hang-off frame
40—winch system
41—winch wire
P1—first position of the movable collar flange
P2—second position of the movable collar flange

The invention claimed is:

1. A hang-off system for hang-off of an end section of a first end of a transfer pipe to a floating structure or vessel, the end section of the transfer pipe being provided with a pipe hang-off flange, wherein the hang-off system comprises:

a gas balcony structure configured for being fastened to an outside of a shipside of the floating structure or vessel, the gas balcony structure comprising a hang-off collar configured to secure the transfer pipe to the gas balcony structure, wherein the hang-off collar comprises:

at least two collar flanges, the at least two collar flanges defining a central opening of the hang-off collar for passing through the end section of the first end of the transfer pipe, and wherein at least one of the collar flanges is movably arranged on the hang-off collar, a linear actuator for moving the at least one movable collar flange between a first position and a second position, wherein when in the first position, the central opening is larger than a transverse cross-sectional area of the pipe hang-off flange, and wherein when in the second position, the central opening is smaller than a transverse cross-sectional area of the pipe hang-off flange, such that at least a portion of the at least two collar flanges is configured to be arranged directly below and parallel with the pipe hang-off flange, whereby the at least two collar flanges are configured to vertically support the transfer pipe via the pipe hang-off flange;

a clamping mechanism configured to clamp the pipe hang-off flange to the at least two collar flanges by applying pressure in a direction parallel to a longitudinal axis of the transfer pipe.

2. The hang-off system according to claim 1, wherein the end section of the first end of the transfer pipe comprises a coupling for connecting to an end of a hose provided on the floating structure or vessel.

3. The hang-off system according to claim 1, wherein the hang-off collar further comprises a locking mechanism for locking the collar flanges in the second position.

4. The hang-off system according to claim 1, wherein the linear actuator is one from the group consisting of: a hydraulic, a pneumatic, and an electrical actuator.

5. The hang-off system according to claim 1, wherein the gas balcony structure comprises a winch system for pull-in and/or release of the transfer pipe through the central opening.

6. The hang-off system according to claim 1, wherein the collar flanges are arranged with an inclination towards the shipside relative to a horizonal plane of the floating structure or vessel, the inclination being adapted to a catenary profile of the transfer pipe.

7. The hang-off system according to claim 1, wherein the collar flanges are provided with pipe grips adapted to the circumference of the transfer pipe end termination for gripping around the transfer pipe when the collar flanges are in the second position and for supporting transversal or bending loads of the transfer pipe.

8. The hang-off system according to claim 1, wherein the hang-off collar comprises two or four movable collar flanges.

9. A method for pull-in of a first end of a transfer pipe using a hang-off system for hang-off of an end section of a first end of a transfer pipe to a floating structure or vessel, the end section of the transfer pipe being provided with a pipe hang-off flange, wherein the hang-off system comprises:

a gas balcony structure configured for being fastened to an outside of a shipside of the floating structure or vessel, the gas balcony structure comprising a hang-off collar configured to secure the transfer pipe to the gas balcony structure, wherein the hang-off collar comprises:

at least two collar flanges, the at least two collar flanges defining a central opening of the hang-off collar for passing through the end section of the first end of the transfer pipe, and wherein at least one of the collar flanges is movably arranged on the hang-off collar, a linear actuator for moving the at least one movable collar flange between a first position and a second position, wherein when in the first position, the central opening is larger than a transverse cross-sectional area of the pipe hang-off flange, and wherein when in the second position, the central opening is smaller than a transverse cross-sectional area of the pipe hang-off flange, such that at least a portion of the at least two collar flanges is configured to be arranged directly below and parallel with the pipe hang-off flange, whereby the at least two collar flanges are configured to vertically support the transfer pipe via the pipe hang-off flange;

a clamping mechanism configured to clamp the pipe hang-off flange to the at least two collar flanges by applying pressure in a direction parallel to a longitudinal axis of the transfer pipe, wherein the gas balcony structure comprises a winch system for pull-in and/or release of the transfer pipe through the central opening, the method comprising:

having the collar flanges in the first position, fastening a winch wire of the winch system to the end section of the transfer pipe, hoisting the end section through the opening of the hang-off collar until the pipe hang-off flange is above the collar flanges, when the hang-off flange is above the collar flanges, moving the collar flanges to the second position using the linear actuator and maintaining the second position, then paying out the winch wire to lower the transfer pipe until the pipe hang-off flange reaches the collar flanges, then clamping the pipe hang-off flange to the collar flanges using the clamping mechanism.

10. The method according to claim 9, wherein the hang-off collar further comprises a locking mechanism for locking the collar flanges in the second position, the method further comprising locking the collar flanges in the second position using the locking mechanism, and releasing the linear actuator.

* * * * *